United States Patent [19]

Moriyama et al.

[11] Patent Number: 5,024,676

[45] Date of Patent: Jun. 18, 1991

[54] SUPER-HEAVY OIL EMULSION FUEL

[75] Inventors: Noboru Moriyama, Wakayama; Tsugitoshi Ogura, Kanagawa; Akio Hiraki, Nagasaki, all of Japan

[73] Assignees: Kao Corporation; Mitsubishi Jukogyo Kabushiki Kaisha, both of Tokyo, Japan

[21] Appl. No.: 394,486

[22] Filed: Aug. 16, 1989

[51] Int. Cl.[5] ..... C10L 1/32

[52] U.S. Cl. ..... 44/301

[58] Field of Search ..... 44/51, 62, 71, 75; 252/309, 312, 356

[56] References Cited

U.S. PATENT DOCUMENTS

| | | | |
|---|---|---|---|
| 4,162,143 | 7/1979 | Yount, III | 44/71 |
| 4,239,052 | 12/1980 | McClaflin | 137/13 |
| 4,392,865 | 7/1983 | Grosse et al. | 252/49.3 |
| 4,494,959 | 11/1985 | Funk | 44/51 |
| 4,618,348 | 10/1986 | Hayes et al. | 44/51 |
| 4,696,638 | 9/1987 | Den Herder et al. | 431/4 |
| 4,801,304 | 1/1989 | Polanco et al. | 431/4 |

OTHER PUBLICATIONS

The Merck Index, Windholz et al., 10th Ed., Merck & Co. Inc., New Jersey, p. 1444, 1983.

*Primary Examiner*—Margaret B. Medley

*Attorney, Agent, or Firm*—Flynn, Thiel, Boutell & Tanis

[57] ABSTRACT

A super-heavy oil emulsion fuel is formed by emulsification using 100 parts by weight of super-heavy oil, 30–80 parts by weight of water, 0.01–4 parts by weight of an anionic surface activating agent, and a nonionic surface activating agent having an HLB (hydrophilic lipophilic balance) of 9–19 at an anionic surface activating agent/-nonionic surface activating agent weight ratio of 1/99–75/25. The super-heavy oil emulsion fuel can also comprise 100 parts by weight of super-heavy oil, 30–80 parts by weight of water, 0.05–4 parts by weight of a nonionic surface active agent having an HLB of 9–19 and, optionally, 0.005–4 parts by weight of an anionic surface active agent.

16 Claims, 1 Drawing Sheet

SUPER-HEAVY OIL EMULSION FUEL

INDUSTRIAL UTILIZATION FIELD

Figure 1:
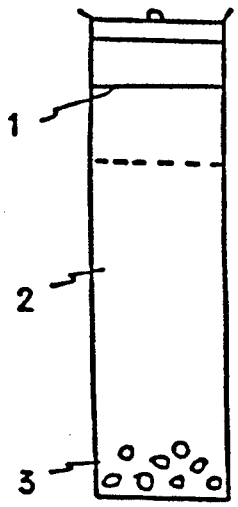

This invention relates to a super-heavy oil emulsion fuel.

DESCRIPTION OF THE PRIOR ART

Buried deposits of fossil fuel resources such as oil sand, bitumen and natural asphalt, which are not contained in petroleum, coal or LNG, are drawing attention as a result of their extremely vast amounts. In addition, with respect to petroleum-based substances also, asphalt and other heat-treated residues from which oil distillates, such as naphtha, have been removed are also in large excess. These super-heavy oils are oily substances which contain approximately 60–70% or more of a heavy fraction of 420°–450° C. or more which is normally the product of distillation under reduced pressure, and either do not flow as is or have high viscosities of several tens of thousands centipoise or more. As a result, when using as a fuel, if not heated to high temperatures, problems relating to handling and atomization occur. In addition, such fuels are also susceptible to blocking of pipes, etc. making them very difficult to use.

DISCLOSURE OF THE INVENTION

The inventors discovered that a super-heavy oil, oil droplets in water type (O/W type) of emulsion fuel in which super-heavy oil (O) is emulsified in water (W) can be prepared when a suitable surface active agent, called also a surface activating agent, is used. This emulsion fuel exhibits a viscosity which is comparatively close to that of water and allows adequate atomization at high temperatures of, for example, 40°–90° C. making it extremely easy to handle. O/W type emulsion fuels are more preferable with a low water (W) content, in other words, with a greater oil (O) content, since fuel loss is less. In order for emulsion fuels to be handled in the same manner as ordinary liquid fuel oils, long-term stability, which allows the fuel to withstand transport and storage, is required. Although there are numerous reports in the past of using oils of satisfactory fluidity such as kerosene, heavy oil A, heavy oil B and heavy oil C by emulsifying them, there are hardly any reports of emulsifying super-heavy oil which has an extremely large heavy fraction and either does not flow or has a viscosity of several tens of thousands centipoise and then using it as a fuel.

The inventors discovered that a low-viscosity, O/W type super-heavy oil emulsion fuel can be prepared using 100 parts (weight standard, same for all to follow) of super-heavy oil, 30–80 parts, and preferably 33–50 parts, of water, 0.01–4 parts by weight of an anionic surface active agent selected from among the groups indicated in (i) to (vii) below and a nonionic surface active agent having an HLB (hydrophilic lipophilic balance) of 9–19 selected from among the groups indicated in (I)–(VII) at an anionic surface active agent/nonionic surface active agent weight ratio of 1/99–75/25, preferably 10/90–40/60, by stirring with a line mixer, etc.

ANIONIC SURFACE ACTIVE AGENT (i) This group consists of formalin condensation products of sulfonic acid or sulfonate salts of cyclical aromatic compounds such as naphthalene, alkylnaphthalene, alkylphenol or alkylbenzene, in which the average degree of condensation of formalin is 1.2–100, and preferably 2–20. The salts are lower amines such as ammonium, monoethanolamine, diethanolamine, triethanolamine and triethylamine or alkaline metals or alkaline earth metals such as sodium, potassium, magnesium and calcium.

(ii) This group consists of the formalin condensation products of lignin sulfonic acid, lignin sulfonate salts, its derivative and lignin sulfonate and sulfonates of aromatic compounds, naphthalene and alkylnaphthalene, and their salts. In any of the cases above, the salts are lower amines such as ammonium, monoethanolamine, diethanolamine, triethanolamine and triethylamine, or alkaline metals or alkaline earth metals such as sodium, potassium, calcium and magnesium. The average degree of condensation of formalin is 1.2–50, and preferably 2–20. For the lignin, the introduction of, for example, a few carboxyl groups results in superior performance particularly at high temperatures.

(iii) This group consists of copolymers and their salts of polystyrene sulfonic acid and its salts as well as styrene sulfonic acid and other copolymerizing monomers in which the molecular weight is 500–500,000, and preferably 2000–100,000. The salts are lower amines such as ammonium, monoethanolamine, diethanolamine, triethanolamine and triethylamine, or alkaline metals or alkaline earth metals such as sodium, potassium, calcium and magnesium. Typical examples of copolymerizing monomers include acrylate, methacrylate, vinyl acetate, acrylic ester, olefins, allyl alcohols as well as their ethylene oxide addition products, and AMPS.

(iv) This group consists of dicyclopentadiene sulfonate polymers and their salts in which the molecular weight of the polymer is 500–500,000, and preferably 2000–100,000. The salts are lower amines such as ammonium, monoethanolamine, diethanolamine, triethanolamine and triethylamine, or alkaline metals or alkaline earth metals such as sodium, potassium, calcium and magnesium.

(v) This group consists of copolymers and their acids and salts of maleic anhydride and/or itaconic anhydride and other copolymerizing monomers in which the molecular weight is 500–500,000, and preferably 1500–100,000. Salts are ammonium as well as alkaline metals such as sodium, and potassium. Examples of the copolymerizing monomer include olefins (ethylene, propylene, butylene, pentene, hexene, heptene, octene, nonene, decene, undecene, dodecene, tridecene, tetradecene, pentadecene, hexadecene), styrene, vinyl acetate, acrylic ester, methacrylate and acrylate.

(vi) This group consists of the maleio compounds and their salts of liquid polybutadiene in which the molecular weight of liquid butadiene is 500–200,000, and preferably 1000–50,000. The copolymer is preferred to have so high a content of maleic anhydride units as to be soluble in water, more preferably 40–70%. Salts include ammonium as well as alkaline metals such as sodium and potassium.

(vii) This group consists of the following anionic surface activating agents having 1 or 2 hydrophilic groups within the same molecule.

(a) Sulfuric ester salts of alcohols having 4–18 carbon atoms in which the salts are lower amines such as ammonium, monoethanolamine, diethanolamine, triethanolamine or triethylamine, or alkaline metals or alkaline earth metals such as sodium, potassium, magnesium or calcium. Typical examples include sodium dodecyl sulfate and sodium octyl sulfate.

(b) Alkanes, alkenes and/or alkylaryl sulfonates or their salts having 4–18 carbon atoms in which the salts are lower amines such as ammonium, monoethanolamine, diethanolamine, triethanolamine and triethylamine, or alkaline metals or alkaline earth metals such as sodium, potassium, magnesium and calcium. Typical examples include sodium dodecylbenzylsulfonate, sodium butylnaphthalenesulfonate and sodium dodecanesulfonate.

(c) Sulfates or phosphate esters and their salts of the alkylene oxide addition products of compounds having 1 or more activated hydrogens within the same molecule. Examples of the salts include ammonium, sodium, potassium, magnesium and calcium. Typical examples include the sodium sulfuric ester salt of polyoxyethyelene (3 mol)nonylphenyl ether and the sodium phosphoric ester salt of polyoxyethylene(3 mol) dodecyl ether.

(d) Sulfosuccinate salts which are esters of saturated or unsaturated fatty acids having 4–22 carbon atoms in which the salts are ammonium, sodium or potassium. Typical examples include sodium or ammonium dioctylsulfosuccinate and sodium dibutylsulfosuccinate.

(e) Alkyldiphenylether disulfonates and their salts. The alkyl groups have 8–18 carbon atoms and the salts are ammonium, sodium, potassium, magnesium and calcium.

(f) Rosin acids and their salts in which the salts are ammonium, sodium and potassium. Tall oil and acid mixture, which is an acid mixture of rosin acid and higher fatty acids, and its salts are also included.

(g) Alkanes or alkene fatty acids having 4–18 carbon atoms and their salts in which the salts are ammonium, potassium and sodium.

NONIONIC SURFACE ACTIVATING AGENTS WITH HLB OF 9–19

(I) This group consists of the alkylene oxide addition products of compounds having phenolic hydroxyl groups such as phenol, cresol, butylphenol, nonylphenol, dinonylphenol, dodecylphenol, para-cumylphenol and bis-phenol A, in which the alkylene oxide is ethylene oxide and/or propylene oxide, butylene oxide or styrene oxide.

(II) This group consists of the alkylene oxide addition products of the formalin condensation products of compounds having phenolic hydroxyl groups such as alkylphenol, phenol, meta-cresol, styrenated phenol and benzylated phenol, in which a condensation degree is 1.2–100, or preferably 2–20. The alkylene oxide is ethylene oxide and/or propylene oxide, butylene oxide or styrene oxide.

(III) This group consists of the alkylene oxide addition products of monovalent aliphatic alcohols and/or aliphatic amines having 2–50 carbon atoms, in which the alkylene oxide is ethylene oxide and/or propylene oxide, butylene oxide or styrene oxide.

(IV) This group consists of the block or random addition polymers of ethylene oxide and propylene oxide and/or butylene oxide and styrene oxide.

(V) This group consists of the alkylene oxide addition products of polyvalent alcohols such as glycerine, trimethylolpropane, pentaerythritol, sorbitol, sucrose, polyglycerine, ethylene glycol, polyethylene glycol, propylene glycol and polypropylene glycol, or the esters of those polyvalent alcohols and fatty acids having 8–18 carbon atoms. The alkylene oxide is ethylene oxide and/or propylene oxide, butylene oxide or styrene oxide.

(VI) Alkylene oxide addition products of polyvalent amines having a multiple number of active hydrogen atoms such as ethylenediamine, tetraethylenediamine and polyethyleneimine (molecular weight: 600–1,000,000). The alkylene oxide is ethylene oxide and/or propylene oxide, butylene oxide or styrene oxide.

(VII) The products of the reaction resulting from the addition of an alkylene oxide to a mixture of 1 mole of triglyceride-type oil and 1 or 2 or more types of polyvalent alcohols selected from the group consisting of glycerine, trimethylolpropane, pentaerythritol, sorbitol, sucrose, ethylene glycol, polyethylene glycol with a molecular weight of 1000 or less, propylene glycol, and polypropylene glycol having a molecular weight of 1000 or less, and/or 0.1–5 moles of water. The alkylene oxide is ethylene oxide and/or propylene oxide, butylene oxide or styrene oxide.

From among the anionic surface activating agents selected from the groups indicated in (i)–(vii) above, the formalin condensation products of lignin sulfonic acid and lignin sulfonate with naphthalene sulfonate and their salts, and the formalin condensation product of naphthalene sulfonate demonstrated particularly superior performance overall. The action of anionic surface active agents involves adsorption onto the interface of the particles of the super-heavy oil thereby giving an electrical charge to the particles while simultaneously assisting in reducing the size of the particles which results in the prevention of the aggregation of the particles. Although nonionic surface active agents are strongly susceptible to the effects of temperature, when anionic surface active agents are added, the effects of temperature are weakened which results in improved storage stability of the emulsion.

The action of the above nonionic surface activating agents involves adsorption onto the interface of the particles of the super-heavy oil and preventing aggregation of the particles as a result of protective action while simultaneously assisting in reducing the size of the particles.

In the case of anionic surface activating agent alone, storage stability is inadequate. Similarly, in the case of nonionic surface activating agent alone, a stable emulsion fuel cannot be obtained since such agents are strongly susceptible to the effects of temperature. By adding anionic surface activating agent to nonionic surface activating agent to reduce their dependence on temperature, it is possible to prepare a stable emulsion fuel.

The amount of anionic surface activating agent that is added in the emulsion fuel of this invention is 0.005–2.2 wt. %, and preferably 0.06–0.61 wt. %. A mixture of two or more types of anionic surface activating agent and nonionic surface activating agent respectively may also be used. In addition, the anionic surface activatig agent and nonionic surface activating agent may be added separately or may be added in the form of a mixture mixed in advance.

Although the optimum HLB value of the nonionic surface activating agent varies according to the temperature at the time of emulsion, a value of 9–19 is preferable with a value of 12–17 being more preferable. From among the nonionic surface activating agents indicated above, the surface activating agent indicated in (VII)

above is the most superior, followed by (II) and (III) which also demonstrate superior performance.

In addition, the inventors discovered that a composition consisting of 100 parts of super-heavy oil, 30–80 parts, and preferably 33–50 parts of water, 0.05–4 parts of nonionic surface activating agent having an HLB value of 9–19, preferably 12–17, which is selected from the groups indicated in (I)–(VII) above, and 0.003–1 part, and preferably 0.01–0.1 part of the naturally-occurring hydrophilic polymer substances indicated in (A)–(D) below, and/or 0.01–1 part of the aqueous synthetic polymers indicated in (a)–(f) below, becomes a stable, O/W type of super-heavy oil emulsion with low viscosity. It is desirable to use efficient, mechanical methods for preparing this composition.

NATURALLY-OCCURRING HYDROPHILIC POLYMER SUBSTANCES (A) Microorganism-Originating Hydrophilic Polymer Substances (Polysaccharides)
- (a) Xanthan Gum
- (b) Bluran
- (c) Dextran (B) Plant-Originating Hydrophilic Polymer Substances (Polysaccharides)
- (a) Kelp-originating
  - (1) Agar
  - (2) Galaginan
  - (3) Phaseleran
  - (4) Arginate and its salts (Na, K, $NH_4$, Ca, Mg)
- (b) Seed-originating
  - (1) Locust Bean Gum
  - (2) Gua Gum
  - (3) Fatsia Gum
  - (4) Tamarind Gum
- (c) Tree-originating (Sap)
  - (1) Arabian Gua
  - (2) Karaya Gum
  - (3) Tragacanth Gum
- (d) Fruit-originating
  - (1) Pectin (C) Animal-Originating Hydrophilic Polymer Substances (Proteins)
- (1) Gelatin
- (2) Casein (D) Natural Polymer Derivatives
- (1) Cellulose derivatives (such as carboxymethylcellulose)
- (2) Processed starch

AQUEOUS SYNTHETIC POLYMERS

The following describes aqueous synthetic polymers with high viscosity.

(a) Homopolymers of acrylate and its derivatives as well as copolymers of other monomers.

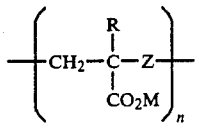

where

R: H, methyl, ethyl

M: H, Na, K, Li, $NH_4$

Z:

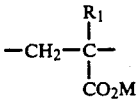

and monomers which can copolymerize with this monomer and its salts ($NH_4$, Na, K, Li).

Examples include maleic acid (anhydride), itaconic acid (anhydride), α-olefins, acrylamide, vinylsulfonate, allylsulfonate, methallylsulfonate, acrylamide methylpropylsulfonate and its salts ($NH_4$, Na, K), and dialkyl(methyl or ethyl)ethylaminomethacrylate and its salts (chlorine, diethylsulfate, dimethylsulfate).

n: 50–100,000

(b) Copolymers of acrylamide and other monomers which can copolymerize with its derivatives.

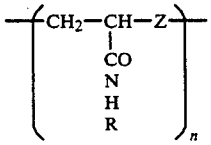

where

R: H, $CH_2CH_2OH$

Z:

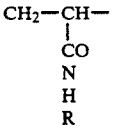

and monomers which can be polymerized with this monomer, and their salts ($NH_4$, Na, K, Li).

Examples include vinylsulfonate, allylsulfonate, methallylsulfonate, acrylamide methylpropylsulfonate, dialkyl(methyl or ethyl)ethylaminomethacrylate, α-olefins ($C_2$–$C_{18}$) and vinylallyl alcohols n: 50–100,000

(c) Salts of copolymers of maleic anhydride, itaconic anhydride and other monomers that can copolymerize. The salt includes that with ammonium, potassium and sodium.

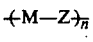

where

M: Maleic anhydride, itaconic anhydride

Z: α-olefins (ethylene, propylene, butylene, isobutylene, octene, decene, dodecene, etc.), styrene n: 50–100,000

(d) Homopolymers and copolymers of vinyl alcohol.

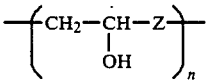

where

Z: Vinyl acetate, styrene n: 30–100,000

(e) Homopolymers and copolymers of vinylpyrrolidone.

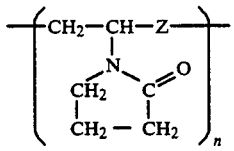

where

Z: Monomers which can copolymerize with vinylpyrrolidone and their salts ($NH_4$, Na, K, Li).

Examples include acrylamide, vinylsulfonate, methallylsulfonate, maleic anhydride, itaconic anhydride, styrene and α-olefins ($C_2$–$C_{18}$).

n: 50–100,000

(f) Polyethyleneoxide (PEO) with a molecular weight of 10,000–3,000,000, and preferably 20,000–1,000,000.

It is preferable to use naturally-occurring hydrophilic polymer substances so that 0.003–1 part, and preferably 0.01–0.1 part are contained in 100 parts of super-heavy oil, and use aqueous synthetic polymers so that 0.01–1 part are contained in 100 parts of super-heavy oil. If the amount that is added is excessive, since the viscosity of the system will be too high and since this is also economically disadvantageous, it is desirable to demonstrate effectiveness with as small an amount as possible. From among the hydrophilic polymer substances indicated above, xanthan gum is especially superior such that superior performance will be exhibited with the addition of a small amount.

When the anionic surface activating agent is further added to the nonionic surface activating agent-hydrophilic polymer substance and/or aqueous synthetic polymer system, a super-heavy oil emulsion fuel results with even greater long-term stability. The anionic surface activating agents indicated in (i)–(vii) above are typical examples of the anionic surface activating agent of this invention.

From among the anionic surface activating agents indicated above, (i) and (ii) exhibited superior performance overall.

When the powerful protective action of the hydrophilic polymer substance is added to the action of the anionic and nonionic surface activating agents, the super-heavy oil emulsion fuel becomes a stable system at low viscosity for an extended period of time.

For systems which use anionic surface activating agent, nonionic surface activating agent and a hydrophilic polymer substance, as well as for systems which use a nonionic surface activating agent and a hydrophilic polymer substance, these can either be used by blending together in advance or used separately. In addition, although these can be added to either water or oil, adding to water results in easier handling.

In regard to mechanical methods for preparing the emulsion fuel, as long as an efficient stirring method is used, any method of this type is satisfactory, and two or more methods may be combined. High-shearing types of stirring devices are particularly desirable. Examples of these include line mixers, arrow blade turbine blade mixers, propeller blade mixers, full margin type blade mixers and paddle blade mixers. High shearing refers to shearing of 1100/sec. or greater, and preferably a range of 4000–30,000/sec.

The action of anionic surface activating agents involves adsorbing onto the interface of the particles of the super-heavy oil thereby giving an electrical charge to the particles while simultaneously assisting in reducing the size of the particles resulting in prevention of aggregation of the particles. Although nonionic surface active agents are strongly susceptible to the effects of temperature, when anionic surface active agents are added, the effects of temperature are weakened resulting in improved storage stability of the emulsion. In addition, storage stability is further improved by adding the action of a hydrophilic polymer substance.

In the case of anionic surface activating agent alone, although the viscosity of the system decreases, storage stability is worsened. Similarly, in the case of using the nonionic surface activating agent alone, viscosity increases with time since such agents are strongly susceptible to the effects of temperature and as such, an emulsion fuel that is stable for an extended period of time cannot be prepared. However, when anionic surface activating agent and nonionic surface activating agent are used in combination, a stable emulsion fuel can be obtained. The weight ratio of anionic surface activating agent and nonionic surface activating agent (anionic surface activating agent/nonionic surface activating agent) which demonstrate superior performance is 1/99–75/25, and preferably 10/90–40/60. An added amount of anionic surface activating agent of 0.005–2.2 parts to 100 parts of emulsion fuel is preferable, and 0.06–0.61 parts is more preferable.

The oil which is referred to as super-heavy oil in this invention includes the oils indicated below which have a high viscosity at room temperature and do not flow unless heated to high temperatures.

(1) Petroleum-based asphalts as well as its mixtures.
(2) Various types of treated petroleum-based asphalt, their intermediate products, residues and oil mixtures.
(3) High fluid point oils or crude oils which do not flow at room temperature.
(4) Petroleum-based tar pitch as well as its mixtures.
(5) Bitumen, oil sand and natural asphalt.

BRIEF DESCRIPTION OF DIAGRAMS

FIG. 1 is a schematic drawing of a centrifuge tube used in evaluation of the dispersion state after allowing to stand undisturbed.

1: Surface Layer
2: Intermediate Layer
3: Sedimentation Layer

EMBODIMENTS

The following describes embodiments of this invention, this invention is not limited to these embodiments.

EMBODIMENT 1

A specific amount of Middle East type asphalt (softening temperature: 50° C.) or Asabaska bitumen (softening temperature: 12.5° C.), water and surface activating agent were weighed so as to total 300 g. This mixture was then placed in an 800 ml centrifuge tube and heated to 75° C. After reaching a constant temperature, the mixture was stirred with a TK Homomixer (Tokushu Kikako Ltd., equipped with low viscosity stirring blades) to prepare the emulsion fuel. This was then maintained at a temperature of 60° C. After reaching a constant temperature, the viscosity was measured. A portion of the emulsion fuel was maintained at a temperature of 50° C. and observed after 1 day, 7 days, 21 days, 1 month and 3 months. A portion was removed and the amount that passed through a 100 mesh strainer was measured. Viscosity measurements were made using a Vismetron Model VS-AI No. 2 (Shibaura Systems Co., Ltd.) at a rotor speed of 60 rpm and the amount that passed through the strainer was determined by placing approximately 10 g of the sample on a $\phi$70 mm, 100 mesh stainless steel strainer in a 50° C. atmosphere and calculating the amount remaining in the strainer after 10 minutes. Those results are indicated in Table 1.

Furthermore, overall evaluation was made by comprehensively evaluating viscosity of the emulsion, amount that passed through the strainer, and visual observation of the dispersion state after the emulsion was allowed to stand. Evaluation was made using the symbols ◎> O>Δ>X with an evaluation of Δ of better being recognized as at least demonstrating some degree of effectiveness.

However, in the case of the dispersion state after standing, evaluation was made by observing the three layers consisting of the surface layer 1, intermediate layer 2 and sedimentation layer 3 as indicated in FIG. 1 and evaluating each of the respective surface layer, intermediate layer and sedimentation layer separately.

In surface layer 1, the size of the oil droplets on the surface were observed as well as the size of the oil film that formed when these were large. Dispersion state was evaluated in the order of no oil droplets>some oil droplets>small oil film>large oil film with no oil droplets indicating the most satisfactory evaluation.

In intermediate layer 2, the quality of the emulsification state was observed Evaluation was made in the order of good emulsification>slightly creamy >creamy>separated>major separation>complete separation with good emulsification indicating the most satisfactory evaluation.

In sedimentation layer 3, evaluation was made in the order of no sediment>soft sediment>hard sediment with no sediment indicating the most satisfactory evaluation. Soft sediment refers to sediment that is soft and can be redispersed easily. Hard sediment refers to sediment that is hard and for which redispersion is difficult.

EMBODIMENT 2

A specific amount of Asabaska bitumen (softening temperature: 12.5° C., Canada), water and each of the surface activating agents indicated in Table 2 were weighed so as to total 300 g. This mixture was then placed in an 800 ml centrifuge tube and heated to 45° C. After reaching a constant temperature, the mixture was stirred with a TK Homomixer, equipped with low viscosity stirring blades, to prepare the emulsion fuel. This was then placed in a 40° C. constant temperature bath. After reaching a constant temperature, the viscosity was measured. A portion of the emulsion fuel was maintained at a temperature of 40° C. and its state was observed after 1 day, 3 days and 7 days. A portion was removed and the amount that passed through a 100 mesh strainer was measured. Viscosity measurements were made using a Vismetron Model VS-AI No. 2 (Shibaura Systems Co., Ltd.) at a rotor speed of 60 rpm and the amount that passed through the strainer was determined by placing approximately 10 g of the sample on a $\phi$70 mm, 100 mesh stainless steel strainer in a 40° C. atmosphere and calculating the amount remaining in the strainer after 10 minutes. Those results are indicated in Table 1. Further, overall evaluation and observation of the dispersion state were performed with the same methods as in Embodiment 1.

EMBODIMENT 3

A specific amount of Middle East type asphalt (softening temperature: 50° C.), water, surface activating agent, hydrophilic polymer substance and/or aqueous synthetic polymer substance were weighed so as to total 300 g. This mixture was then placed in an 800 ml centrifuge tube and heated to 75° C. After reaching a constant temperature, the mixture was stirred with a TK Homomixer (Tokushu Kikako Ltd., equipped with low viscosity stirring blades) to prepare the emulsion fuel. This was then maintained at a temperature of 60° C. After reaching a constant temperature, the viscosity was measured. A portion of the emulsion fuel was maintained at a temperature of 50° C. and observed after 1 day, 7 days, 21 days, 1 month and 3 months. A portion was removed and the amount that passed through a 100 mesh strainer was measured. Viscosity measurements were made using a Vismetron Model VS-AI No. 2 (Shibaura Systems Co., Ltd.) at a rotor speed of 60 rpm and the amount that passed through the strainer was determined by placing approximately 10 g of the sample on a $\phi$70 mm, 100 mesh stainless steel strainer in a 50° C. atmosphere and calculating the amount remaining in the strainer after 10 minutes. Those results are indicated in Table 3. Further, overall evaluation and observation of the dispersion state were performed with the same methods as in Embodiment 1.

EMBODIMENT 4

A specific amount of Asabaska bitumen (softening temperature: 12.5° C., Canada), water, surface activating agent, hydrophilic polymer substance and/or aqueous synthetic polymer substance were weighed so as to total 300 g. This mixture was then placed in an 800 ml centrifuge tube and heated to 40° C. After reaching a constant temperature, the mixture was stirred with a TK Homomixer (Tokushu Kikako Ltd.) to prepare the emulsion fuel. This was then placed in a 40° C. constant temperature bath. After reaching a constant temperature, the viscosity was measured. A portion of the emulsion fuel was maintained at a temperature of 40° C. and its state was observed after 1 day, 7 days, 21 days, 1 month and 3 months. A portion was removed and the amount that passed through a 100 mesh strainer was measured. Viscosity measurements were made using a Vismetron Model VS-AI No. 2 (Shibaura Systems Co., Ltd.) at a rotor speed of 60 rpm and the amount that passed through the strainer was determined by placing approximately 10 g of the sample on a $\phi$70 mm, 100 mesh stainless steel strainer in a 40° C. atmosphere and calculating the amount remaining in the strainer after 10 minutes. Those results are indicated in Table 4. Further, overall evaluation and observation of the dispersion state were performed with the same methods as in Embodiment 3.

TABLE 1

| Test No. | Asphalt Concentration (%) | Surface Activating Agents and Amount of Addition (%): Anionic Surface Activating Agent | Surface Activating Agents and Amount of Addition (%): Nonionic Surface Activating Agent | Physical Properties During Preparation: Viscosity (c.P. 60° C.) | Physical Properties During Preparation: Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|
| 1 | 74 | Sodium Lignosulfonate 0.60% | Polyoxyethylene Nonylphenyl Ether (HLB 15.5) 0% | 77 | 0 | Large Oil Film | No Change | No Change | X |
| | | | | | | Complete Separation | No Change | No Change | |
| | | | | | | Hard Sediment | No Change | No Change | |
| 2 | 74 | Sodium Lignosulfonate 0.40% | Polyoxyethylene Nonylphenyl Ether (HLB 15.5) 0.20% | 105 | 19 | Large Oil Film | No Change | No Change | Δ |
| | | | | | | Major Separation | No Change | No Change | |
| | | | | | | Soft Sediment | No Change | Hard Sediment | |
| 3 | 74 | Sodium Lignosulfonate 0.30% | Polyoxyethylene Nonylphenyl Ether (HLB 15.5) 0.30% | 158 | 11 | Small Oil Film | No Change | No Change | Δ |
| | | | | | | Major Separation | No Change | No Change | |
| | | | | | | Soft Sediment | No Change | Hard Sediment | |
| 4 | 74 | Sodium Lignosulfonate 0.20% | Polyoxyethylene Nonylphenyl Ether (HLB 15.5) 0.40% | 248 | 43 | Small Oil Film | No Change | No Change | O |
| | | | | | | Good Emulsification | No Change | No Change | |
| | | | | | | No Sediment | No Change | Soft Sediment | |
| 5 | 74 | Sodium Lignosulfonate 0.12% | Polyoxyethylene Nonylphenyl Ether (HLB 15.5) 0.48% | 350 | 39 | Small Oil Film | No Change | No Change | O |
| | | | | | | Good Emulsification | No Change | No Change | |
| | | | | | | No Sediment | No Change | No Change | |
| 6 | 74 | Sodium Lignosulfonate 0.06% | Polyoxyethylene Nonylphenyl Ether (HLB 15.5) 0.54% | 1200 | 34 | No Oil Droplets | No Change | Small Oil Film | Δ |
| | | | | | | Good Emulsification | No Change | Slightly Creamy | |
| | | | | | | No Sediment | No Change | No Change | |
| 7 | 74 | Sodium Lignosulfonate 0% | Polyoxyethylene Nonylphenyl Ether (HLB 15.5) 0.60% | 4170 | 17 | Large Oil Film | No Change | No Change | X |
| | | | | | | Creamy | No Change | No Change | |
| | | | | | | No Sediment | No Change | No Change | |
| 8 | 74 | Sodium Lignosulfonate 0.13% | Polyoxyethylene Nonylphenyl Ether (HLB 15.5) 0.27% | 208 | 39 | Some Oil Droplets | No Change | No Change | O |
| | | | | | | Good Emulsification | No Change | No Change | |
| | | | | | | No Sediment | No Change | No Change | |
| 9 | 74 | Sodium Lignosulfonate 0.17% | Polyoxyethylene Nonylphenyl Ether (HLB 15.5) 0.33% | 291 | 41 | Some Oil Droplets | No Change | No Change | O |
| | | | | | | Good Emulsification | No Change | No Change | |
| | | | | | | No Sediment | No Change | No Change | |
| 10 | 74 | Sodium Lignosulfonate 0.27% | Polyoxyethylene Nonylphenyl Ether (HLB 15.5) 0.53% | 270 | 43 | Some Oil Droplets | No Change | No Change | O |
| | | | | | | Creamy | No Change | No Change | |
| | | | | | | No Sediment | No Change | No Change | |
| 11 | 72 | Sodium Lignosulfonate 0.20% | Polyoxyethylene Nonylphenyl Ether (HLB 15.5) 0.40% | 129 | 46 | Some Oil Droplets | No Change | No Change | O |
| | | | | | | Good Emulsification | No Change | No Change | |
| | | | | | | No Sediment | No Change | No Change | |
| 12 | 70 | Sodium Lignosulfonate | Polyoxyethylene Nonylphenyl | 105 | 44 | Some Oil Droplets | No Change | No Change | O |
| | | | | | | Good | No Change | No Change | |

TABLE 1-continued

| Test No. | Asphalt Concentration (%) | Surface Activating Agents and Amount of Addition (%): Anionic Surface Activating Agent | Surface Activating Agents and Amount of Addition (%): Nonionic Surface Activating Agent | Physical Properties During Preparation: Viscosity (c.P. 60° C.) | Physical Properties During Preparation: Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|
| 13 | 74 | 0.20% Calcium Salt of Lignosulfonate 0.20% | Ether (HLB 15.5) 0.40% Polyoxyethylene Nonylphenyl Ether (HLB 15.5) 0.40% | 560 | 23 | Emulsification No Sediment Small Oil Film Good | No Change No Change No Change | No Change No Change Creamy | O |
| 14 | 74 | Ammonium Salt of Lignosulfonate 0.20% | Polyoxyethylene Nonylphenyl Ether (HLB 15.5) 0.40% | 420 | 25 | Emulsification No Sediment Small Oil Film Good | No Change No Change No Change | Soft Sediment No Change Slightly Creamy | O |
| 15 | 74 | Formalin Condensate of Sodium Salt of Lignosulfonate 0.20% | Polyoxyethylene Nonylphenyl Ether (HLB 15.5) 0.40% | 490 | 30 | Emulsification No Sediment Small Oil Film Good | No Change No Change No Change | Soft Sediment No Change Slightly Creamy | O |
| 16 | 74 | Formalin Condenstate of Sodium Salt of Naphthalene Sulfonate 0.20% | Polyoxyethylene Nonylphenyl Ether (HLB 15.5) 0.40% | 205 | 46 | Emulsification No Sediment Some Oil Droplets Good | No Change No Change No Change | Soft Sediment No Change No Change | O |
| 17 | 74 | Formalin Condensate of Sodium Salt of Naphthalene Sulfonate 0.13% | Polyoxyethylene Nonylphenyl Ether (HLB 15.5) 0.27% | 180 | 28 | Emulsification No Sediment Small Oil Film Good | No Change No Change No Change | No Change No Change No Change | O |
| 18 | 74 | Formalin Condensate of Sodium Salt of Cresol Sulfonate 0.20% | Polyoxyethylene Nonylphenyl Ether (HLB 15.5) 0.40% | 620 | 18 | Emulsification No Sediment Small Oil Film Good | No Change No Change Slightly Creamy | Soft Sediment No Change No Change | Δ |
| 19 | 74 | Formalin Condensate of Sodium Salt of Butylnaphthalene Sulfonate 0.20% | Polyoxyethylene Nonylphenyl Ether (HLB 15.5) 0.40% | 240 | 41 | Emulsification No Sediment Some Oil Droplets Good | Soft Sediment No Change No Change | Soft Sediment No Change No Change | O |
| 20 | 74 | Formalin Condensate of Butylnaphthalene Sulfonate 0.20% | Polyoxyethylene Nonylphenyl Ether (HLB 15.5) 0.40% | 270 | 42 | Emulsification No Sediment Some Oil Droplets Good | No Change No Change No Change | No Change No Change No Change | O |
| 21 | 74 | Sodium Polystyrene Sulfonate (MW: 8,000) 0.20% | Polyoxyethylene Nonylphenyl Ether (HLB 15.5) 0.40% | 780 | 23 | Emulsification No Sediment Small Oil Film Good | No Change No Change Slightly Creamy | No Change No Change No Change | Δ |
| 22 | 74 | Sodium Salt of Styrene Sulfonate-Maleate Copolymer (MW: 6,000) 0.20% | Polyoxyethylene Nonylphenyl Ether (HLB 15.5) 0.40% | 890 | 25 | Emulsification No Sediment Small Oil Film Slightly Creamy No Sediment | Soft Sediment Large Oil Film No Change Soft Sediment | No Change No Change No Change No Change | Δ |
| 23 | 74 | Sodium Salt of Dicyclopentadiene | Polyoxyethylene Nonylphenyl Ether | 950 | 22 | Small Oil Film Slightly Creamy | Large Oil Film No Change | No Change No Change | Δ |

TABLE 1-continued

| Test No. | Asphalt Concentration (%) | Surface Activating Agents and Amount of Addition (%): Anionic Surface Activating Agent | Surface Activating Agents and Amount of Addition (%): Nonionic Surface Activating Agent | Physical Properties During Preparation: Viscosity (c.P. 60° C.) | Physical Properties During Preparation: Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|
| | | Sulfonate Copolymer (MW: 8,000) 0.20% | (HLB 15.5) 0.40% | | | No Sediment | No Change | No Change | |
| 24 | 74 | Sodium Salt of Denatured Lignosulfonate 0.20% | Polyoxyethylene Nonylphenyl Ether (HLB 15.5) 0.40% | 200 | 45 | Small Oil Film<br>Good Emulsification<br>No Sediment | No Change<br>No Change<br>No Change | No Change<br>No Change<br>Soft Sediment | O |
| 25 | 74 | Sodium Salt of Octene-Maleate Copolymer (MW: 6,000) 0.20% | Polyoxyethylene Nonylphenyl Ether (HLB 15.5) 0.40% | 360 | 32 | Small Oil Film<br>Good Emulsification<br>No Sediment | No Change<br>No Change<br>Soft Sediment | No Change<br>No Change<br>No Change | O |
| 26 | 74 | Sodium Salt of Maleated Liquid Polybutadiene (MW: 4,000) (Degree of Maleation: 50%) 0.20% | Polyoxyethylene Nonylphenyl Ether (HLB 15.5) 0.40% | 430 | 26 | Small Oil Film<br>Slightly Creamy<br>No Sediment | Large Oil Film<br>No Change<br>Soft Sediment | No Change<br>No Change<br>No Change | Δ |
| 27 | 74 | Sodium Salt of Lauryl Sulfate 0.20% | Polyoxyethylene Nonylphenyl Ether (HLB 15.5) 0.40% | 660 | 28 | Small Oil Film<br>Good Emulsification<br>No Sediment | No Change<br>No Change<br>Soft Sediment | Large Oil Film<br>No Change<br>No Change | Δ |
| 28 | 74 | Triethanolamine Salt of Lauryl Sulfate 0.20% | Polyoxyethylene Nonylphenyl Ether (HLB 15.5) 0.40% | 690 | 24 | Small Oil Film<br>Good Emulsification<br>No Sediment | Large Oil Film<br>No Change<br>Soft Sediment | No Change<br>No Change<br>No Change | Δ |
| 29 | 74 | Sodium Salt of Polyoxyethylene (n = 3) Nonylphenyl Ether Sulfate 0.20% | Polyoxyethylene Nonylphenyl Ether (HLB 15.5) 0.40% | 390 | 37 | Small Oil Film<br>Good Emulsification<br>No Sediment | No Change<br>No Change<br>No Change | No Change<br>No Change<br>Soft Sediment | O |
| 30 | 74 | Sodium Salt of Polyoxyethylene (n = 3) Nonylphenyl Ether Phosphate 0.20% | Polyoxyethylene Nonylphenyl Ether (HLB 15.5) 0.40% | 430 | 38 | Small Oil Film<br>Good Emulsification<br>No Sediment | No Change<br>No Change<br>Soft Sediment | No Change<br>No Change<br>No Change | O |
| 31 | 74 | Sodium Salt of Dioctylsulfosuccinate 0.20% | Polyoxyethylene Nonylphenyl Ether (HLB 15.5) 0.40% | 580 | 29 | Small Oil Film<br>Good Emulsification<br>No Sediment | Large Oil Film<br>No Change<br>Soft Sediment | No Change<br>No Change<br>No Change | Δ |
| 32 | 74 | Sodium Salt of Rosin Soap 0.20% | Polyoxyethylene Nonylphenyl Ether (HLB 15.5) 0.40% | 460 | 30 | Small Oil Film<br>Good Emulsification<br>No Sediment | Large Oil Film<br>No Change<br>Soft Sediment | No Change<br>No Change<br>No Change | O |
| 33 | 74 | Sodium Lignosulfonate 0.20% | Ethylene Oxide Addition Product of Nonylphenol Formalin | 350 | 44 | Small Oil Film<br>Good Emulsification | No Change<br>No Change | No Change<br>Slightly Creamy | O |

TABLE 1-continued

| Test No. | Asphalt Concentration (%) | Surface Activating Agents and Amount of Addition (%): Anionic Surface Activating Agent | Surface Activating Agents and Amount of Addition (%): Nonionic Surface Activating Agent | Physical Properties During Preparation: Viscosity (c.P. 60° C.) | Physical Properties During Preparation: Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|
| | | | Condensate (HLB 15.2) 0.40% | | | No Sediment | No Change | Soft Sediment | |
| 34 | 74 | Sodium Lignosulfonate 0.20% | Polyoxyethylene Oleyl Ether (HLB 15.7) 0.40% | 380 | 43 | Small Oil Film<br>Good Emulsification<br>No Sediment | No Change<br>No Change<br>No Change | No Change<br>Slightly Creamy<br>Soft Sediment | O |
| 35 | 74 | Sodium Lignosulfonate 0.20% | Polyoxyethylene Sorbitan Laurate (HLB 15.2) 0.40% | 510 | 36 | Small Oil Film<br>Good Emulsification<br>No Sediment | No Change<br>No Change<br>No Change | No Change<br>Slightly Creamy<br>Soft Sediment | O |
| 36 | 74 | Sodium Lignosulfonate 0.20% | Polyoxypropylene (MW: 1,500) Polyoxyethylene Block Polymer (HLB 15.8) 0.40% | 560 | 38 | Small Oil Film<br>Good Emulsification<br>No Sediment | No Change<br>No Change<br>No Change | No Change<br>Slightly Creamy<br>Soft Sediment | O |
| 37 | 74 | Sodium Lignosulfonate 0.20% | Ethylene Oxide and Propylene Oxide Block Polymer of Tetraethyleneamine (HLB 15.1) 0.40% | 620 | 17 | Small Oil Film<br>Good Emulsification<br>No Sediment | No Change<br>No Change<br>Soft Sediment | No Change<br>Creamy<br>No Change | Δ |
| 38 | 74 | Sodium Lignosulfonate 0.20% | Ethylene Oxide Addition Product of a Mixture of Beef Tallow and Glycerine (1:0.5) (HLB 15.5) 0.40% | 151 | 48 | Some Oil Droplets<br>Good Emulsification<br>No Sediment | No Change<br>No Change<br>No Change | No Change<br>No Change<br>Soft Sediment | O |
| 39 | 74 | Sodium Lignosulfonate 0.20% | Polyoxyethylene Nonylphenyl Ether (HLB 8.8) 0.40% | 920 | 4 | Large Oil Film<br>Separation<br>Soft Sediment | No Change<br>No Change<br>Hard Sediment | No Change<br>No Change<br>No Change | X |
| 40 | 74 | Sodium Lignosulfonate 0.20% | Polyoxyethylene Nonylphenyl Ether (HLB 12.2) 0.40% | 650 | 8 | Small Oil Film<br>Slightly Creamy<br>No Sediment | Large Oil Film<br>Creamy<br>Soft Sediment | No Change<br>No Change<br>No Change | Δ |
| 41 | 74 | Sodium Lignosulfonate 0.20% | Polyoxyethylene Nonylphenyl Ether (HLB 17.8) 0.40% | 238 | 41 | Some Oil Droplets<br>Good Emulsification<br>No Sediment | No Change<br>No Change<br>No Change | No Change<br>No Change<br>No Change | O |
| 42 | 74 | Sodium Lignosulfonate 0.20% | Polyoxyethylene Nonylphenyl Ether (HLB 19.1) 0.40% | 760 | 14 | Small Oil Film<br>Creamy<br>Soft Sediment | Large Oil Film<br>No Change<br>No Change | No Change<br>No Change<br>Hard Sediment | X |

TABLE 2

| Test No. | Asabaska Bitumen Concentration (%) | Surface Activating Agents and Amount of Addition (%): Anionic Surface Activating Agent | Nonionic Surface Activating Agent | Polymer Substance | Physical Properties During Preparation: Viscosity (c.P. 40° C.) | Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|---|
| 1 | 73 | Sodium Lignosulfonate 0% | Polyoxyethylene Nonylphenyl Ether 0% | Xanthan Gum 0% | Immeasurable | 0 | Test Discontinued | | | X |
| 2 | 73 | Sodium Lignosulfonate 0.20% | Polyoxyethylene Nonylphenyl Ether (HLB 9.2) 0.40% | Xanthan Gum 0% | 490 | 21 | Small Oil Film Slightly Creamy No Sediment | No Change No Change No Change | Large Oil Film No Change Soft Sediment | Δ |
| 3 | 73 | Sodium Lignosulfonate 0.20% | Polyoxyethylene Nonylphenyl Ether (HLB 12.2) 0.40% | Xanthan Gum 0% | 190 | 43 | No Oil Droplets Good Emulsification No Sediment | No Change No Change No Change | No Change No Change No Change | O |
| 4 | 73 | Sodium Lignosulfonate 0.20% | Polyoxyethylene Nonylphenyl Ether (HLB 13.2) 0.40% | Xanthan Gum 0% | 170 | 46 | No Oil Droplets Good Emulsification No Sediment | No Change No Change No Change | No Change No Change No Change | O |
| 5 | 73 | Sodium Lignosulfonate 0.20% | Polyoxyethylene Nonylphenyl Ether (HLB 15.5) 0.40% | Xanthan Gum 0% | 230 | 29 | No Oil Droplets Slightly Creamy No Sediment | No Change No Change No Change | No Change Creamy Soft Sediment | Δ |
| 6 | 73 | Sodium Lignosulfonate 0.20% | Polyoxyethylene Nonylphenyl Ether (HLB 17.8) 0.40% | Xanthan Gum 0% | 350 | 20 | Small Oil Film Slightly Creamy No Sediment | No Change Creamy Soft Sediment | No Change No Change No Change | Δ |
| 7 | 73 | Sodium Lignosulfonate 0.20% | Polyoxyethylene Nonylphenyl Ether (HLB 19.1) 0.40% | Xanthan Gum 0% | 830 | 15 | Small Oil Film Creamy No Sediment | No Change No Change Soft Sediment | No Change No Change Hard Sediment | X |
| 8 | 73 | Sodium Lignosulfonate 0.20% | Ethylene Oxide Addition Product of a Mixture of Beef Tallow and Glycerine (1:0.5) (HLB 13.2) 0.40% | Xanthan Gum 0% | 165 | 51 | No Oil Droplets Good Emulsification No Sediment | No Change No Change No Change | No Change No Change No Change | O |
| 9 | 73 | Formalin Condensate of Sodium Naphthalene Sulfonate (Degree of Condensation: 4.1) | Ethylene Oxide Addition Product of a Mixture of Beef Tallow and Glycerine (1:0.5) | Xanthan Gum 0% | 173 | 49 | No Oil Droplets Good Emulsification No Sediment | No Change No Change No Change | No Change No Change No Change | O |

TABLE 2-continued

| Test No. | Asabaska Bitumen Concentration (%) | Surface Activating Agents and Amount of Addition (%): Anionic Surface Activating Agent | Nonionic Surface Activating Agent | Polymer Substance | Physical Properties During Preparation: Viscosity (c.P. 40° C.) | Amount Passing Through Strainer (100 Mesh) (%) | Observation of Dispersion State After Standing: After 1 Day | After 3 Days | After 7 Days | Overall Evaluation |
|---|---|---|---|---|---|---|---|---|---|---|
| 10 | 73 | 0.20%<br>Formalin Condensate of Sodium Naphthalene Sulfonate (Degree of Condensation: 4.1)<br>0.20% | (HLB 13.2)<br>0.40%<br>Polyoxyethylene Nonylphenyl Ether (HLB 13.2)<br>0.40% | Xanthan Gum<br>0% | 172 | 48 | No Oil Droplets<br>Good Emulsification<br>No Sediment | No Change<br>No Change<br>No Change | No Change<br>No Change<br>No Change | O |

TABLE 3

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| 1 | 74 | Sodium Ligno-sulfonate 0% | Polyoxy-ethylene Nonylphenyl Ether (HLB 15.5) 0% | Xanthan Gum 0% | 40000 | 0 | Large Oil Film | No Change | Test Discontinued | | | X |
| | | | | | | | Complete Separation | No Change | Test Discontinued | | | |
| | | | | | | | Hard Sediment | No Change | Test Discontinued | | | |
| 2 | 74 | Sodium Ligno-sulfonate 0.20% | Polyoxy-ethylene Nonylphenyl Ether (HLB 15.5) 0.40% | Xanthan Gum 0% | 248 | 43 | Small Oil Film | No Change | Large Oil Film | No Change | No Change | X |
| | | | | | | | Good Emulsification | No Change | Slightly Creamy | Creamy | No Change | |
| | | | | | | | No Sediment | Soft Sediment | No Change | No Change | Hard Sediment | |
| 3 | 74 | Sodium Ligno-sulfonate 0.20% | Polyoxy-ethylene Nonylphenyl Ether (HLB 15.5) 0.40% | Xanthan Gum 0.008% | 265 | 66 | No Oil Droplets | No Change | No Change | No Change | No Change | Δ |
| | | | | | | | Good Emulsification | No Change | No Change | Slightly Creamy | No Change | |
| | | | | | | | No Sediment | No Change | No Change | No Change | Hard Sediment | |
| 4 | 74 | Sodium Ligno-sulfonate 0.20% | Polyoxy-ethylene Nonylphenyl Ether (HLB 15.5) 0.40% | Xanthan Gum 0.010% | 303 | 75 | No Oil Droplets | No Change | No Change | No Change | No Change | O |
| | | | | | | | Good Emulsification | No Change | No Change | Slightly Creamy | No Change | |
| | | | | | | | No Sediment | No Change | No Change | No Change | Soft Sediment | |
| 5 | 74 | Sodium Ligno-sulfonate 0.20% | Polyoxy-ethylene Nonylphenyl Ether (HLB 15.5) 0.40% | Xanthan Gum 0.020% | 340 | 70 | No Oil Droplets | No Change | No Change | No Change | No Change | ◎ |
| | | | | | | | Good Emulsification | No Change | No Change | No Change | Slightly Creamy | |
| | | | | | | | No Sediment | No Change | No Change | No Change | No Change | |
| 6 | 74 | Sodium Ligno-sulfonate 0.20% | Polyoxy-ethylene Nonylphenyl Ether (HLB 15.5) 0.40% | Xanthan Gum 0.040% | 370 | 64 | No Oil Droplets | No Change | No Change | No Change | No Change | ◎ |
| | | | | | | | Good Emulsification | No Change | No Change | No Change | Slightly Creamy | |
| | | | | | | | No Sediment | No Change | No Change | No Change | No Change | |
| 7 | 74 | Sodium Ligno-sulfonate 0.20% | Polyoxy-ethylene Nonylphenyl Ether (HLB 15.5) 0.40% | Xanthan Gum 0.100% | 490 | 60 | No Oil Droplets | No Change | No Change | No Change | No Change | ◎ |
| | | | | | | | Good Emulsification | No Change | No Change | Slightly Creamy | No Change | |
| | | | | | | | No Sediment | No Change | No Change | No Change | No Change | |
| 8 | 74 | Sodium | Polyoxy- | Xanthan Gum | 800 | 45 | No Oil | No Change | No Change | No | No | Δ |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | Ligno-sulfonate 0.20% | ethylene Nonylphenyl Ether (HLB 15.5) 0.40% | 0.200% | | | Droplets Good Emulsification No Sediment | No Change No Change | No Change No Change | Change Creamy No Change | Change No Change No Change | |
| 9 | 74 | Sodium Ligno-sulfonate 0.10% | Polyoxy-ethylene Nonylphenyl Ether (HLB 15.5) 0.40% | Xanthan Gum 0% | 350 | 39 | Small Oil Film Good Emulsification No Sediment | No Change No Change No Change | Large Oil Film Slightly Creamy Soft Sediment | No Change No Change No Change | No Change Creamy Hard Sediment | X |
| 10 | 74 | Sodium Ligno-sulfonate 0.10% | Polyoxy-ethylene Nonylphenyl Ether (HLB 15.5) 0.40% | Xanthan Gum 0.040% | 390 | 62 | No Oil Droplets Good Emulsification No Sediment | No Change No Change No Change | No Change No Change No Change | No Change Slightly Creamy No Change | No Change No Change No Change | ◎ |
| 11 | 72 | Sodium Ligno-sulfonate 0.20% | Polyoxy-ethylene Nonylphenyl Ether (HLB 15.5) 0.40% | Xanthan Gum 0% | 129 | 46 | Some Oil Droplets Good Emulsification No Sediment | No Change No Change No Change | Small Oil Film Slightly Creamy Slight Soft Sediment | No Change Creamy Soft Sediment | Large Oil Film No Change Hard Sediment | X |
| 12 | 72 | Sodium Ligno-sulfonate 0.20% | Polyoxy-ethylene Nonylphenyl Ether (HLB 15.5) 0.40% | Xanthan Gum 0.040% | 240 | 67 | No Oil Droplets Good Emulsification No Sediment | No Change No Change No Change | No Change No Change No Change | No Change No Change No Change | No Change Slightly Creamy No Change | ◎ |
| 13 | 70 | Sodium Ligno-sulfonate 0.20% | Polyoxy-ethylene Nonylphenyl Ether (HLB 15.5) 0.40% | Xanthan Gum 0% | 105 | 44 | Some Oil Droplets Good Emulsification No Sediment | No Change No Change No Change | Small Oil Film No Change Soft Sediment | No Change Creamy No Change | No Change No Change Hard Sediment | X |
| 14 | 70 | Sodium Ligno-sulfonate 0.20% | Polyoxy-ethylene Nonylphenyl Ether (HLB 15.5) 0.40% | Xanthan Gum 0.040% | 210 | 70 | No Oil Droplets Good Emulsification No Sediment | No Change No Change No Change | No Change No Change No Change | No Change No Change No Change | No Change Slightly Creamy No Change | ◎ |
| 15 | 74 | Formalin Condensate | Polyoxy-ethylene | Xanthan Gum 0% | 205 | 46 | Some Oil Droplets | No Change | Small Oil Film | No Change | Large Oil Film | X |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | of Sodium Naphthalene Sulfonate (Degree of Condensation: 4.1) 0.20% | Nonylphenyl Ether (HLB 15.5) 0.40% | | | | Good Emulsification No Sediment | No Change No Change | Slightly Creamy No Change | No Change Soft Sediment | Creamy Hard Sediment | |
| 16 | 74 | Formalin Condensate of Sodium Naphthalene Sulfonate (Degree of Condensation: 4.1) 0.20% | Polyoxyethylene Nonylphenyl Ether (HLB 15.5) 0.40% | Xanthan Gum 0.040% | 210 | 73 | No Oil Droplets Good Emulsification No Sediment | No Change No Change No Change | No Change No Change No Change | No Change No Change No Change | No Change Slightly Creamy No Change | ◎ |
| 17 | 74 | Sodium Lignosulfonate 0.20% | Ethylene Oxide Addition Product of a Mixture of Beef Tallow and Glycerine (1:0.5) (HLB 15.5) 0.40% | Xanthan Gum 0% | 151 | 48 | Some Oil Droplets Good Emulsification No Sediment | No Change No Change Soft Sediment | Small Oil Film No Change | No Change Slight Soft Sediment No Change | Large Oil Film Creamy Hard Sediment | X |
| 18 | 74 | Sodium Lignosulfonate 0.20% | Ethylene Oxide Addition Product of a Mixture of Beef Tallow and Glycerine (1:0.5) (HLB 15.5) 0.40% | Xanthan Gum 0.040% | 220 | 82 | No Oil Droplets Good Emulsification No Sediment | No Change No Change No Change | No Change No Change No Change | No Change No Change No Change | No Change No Change No Change | ◎ |
| 19 | 74 | Sodium Lignosulfonate 0.20% | Polyoxyethylene Oleyl Ether (HLB 15.7) 0.40% | Xanthan Gum 0% | 380 | 43 | Small Oil Film Good Emulsification No Sediment | No Change Slightly Creamy Soft | Large Oil Film No Change No Change | No Change Creamy No | No Change No Change Hard | X |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| 20 | 74 | Sodium Ligno-sulfonate 0.20% | Polyoxy-ethylene Oleyl Ether (HLB 15.7) 0.40% | Xanthan Gum 0.040% | 450 | 72 | No Oil Droplets Good Emulsification No Sediment | Sediment No Change No Change No Change | No Change No Change No Change | Change No Change No Change No Change | Sediment No Change Slightly Creamy No Change | ◎ |
| 21 | 74 | Sodium Ligno-sulfonate 0.20% | Polyoxy-ethylene Nonylphenyl Ether (HLB 15.5) 0.40% | Sodium Arginate Salt 0.040% | 280 | 50 | Some Oil Droplets Good Emulsification No Sediment | No Change No Change No Change | Small Oil Film No Change No Change | No Change Slightly Creamy Soft Sediment | No Change No Change No Change | ○ |
| 22 | 74 | Sodium Ligno-sulfonate 0.20% | Polyoxy-ethylene Nonylphenyl Ether (HLB 15.5) 0.40% | Gua Gum 0.040% | 300 | 52 | Some Oil Droplets Good Emulsification No Sediment | No Change No Change No Change | Small Oil Film No Change No Change | No Change Slightly Creamy Soft Sediment | No Change No Change No Change | ○ |
| 23 | 74 | Sodium Ligno-sulfonate 0.20% | Polyoxy-ethylene Nonylphenyl Ether (HLB 15.5) 0.40% | Locust Bean Gum 0.040% | 340 | 57 | Some Oil Droplets Good Emulsification No Sediment | No Change No Change No Change | No Change No Change No Change | Small Oil Film Slightly Creamy Soft Sediment | No Change No Change No Change | ○ |
| 24 | 74 | Sodium Ligno-sulfonate 0.20% | Polyoxy-ethylene Nonylphenyl Ether (HLB 15.5) 0.40% | Arabian Gum 0.040% | 270 | 49 | Some Oil Droplets Good Emulsification No Sediment | No Change No Change No Change | Small Oil Film No Change No Change | No Change Slightly Creamy Soft Sediment | No Change No Change No Change | ○ |
| 25 | 74 | Sodium Ligno-sulfonate 0.20% | Polyoxy-ethylene Nonylphenyl Ether (HLB 15.5) 0.40% | Casein Ammonium Salt 0.040% | 310 | 52 | Some Oil Droplets Good Emulsification No Sediment | No Change No Change No Change | Small Oil Film No Change No Change | No Change Slightly Creamy Soft Sediment | No Change No Change No Change | ○ |
| 26 | 74 | Sodium Ligno-sulfonate 0.20% | Polyoxy-ethylene Nonylphenyl Ether (HLB 15.5) 0.40% | Carboxy-methyl-cellulose 0.040% | 270 | 46 | Some Oil Droplets Good Emulsification No Sediment | No Change No Change No Change | Small Oil Film No Change No Change | No Change Slightly Creamy Soft Sediment | Large Oil Film No Change No Change | ○ |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| 27 | 74 | Sodium Ligno-sulfonate 0.20% | Polyoxy-ethylene Nonylphenyl Ether (HLB 15.5) 0.40% | Sodium Polyacrylate (MW: 400,000 0.040% | 340 | 48 | Some Oil Droplets Good Emulsification No Sediment | No Change No Change No Change | Small Oil Film No Change No Change | No Change Slightly Creamy Soft Sediment | No Change No Change No Change | O |
| 28 | 74 | Sodium Ligno-sulfonate 0.20% | Polyoxy-ethylene Nonylphenyl Ether (HLB 15.5) 0.40% | Polyacrylamide (MW: 300,000) 0.040% | 360 | 45 | Some Oil Droplets Good Emulsification No Sediment | No Change No Change No Change | Small Oil Film No Change No Change | No Change Slightly Creamy Soft Sediment | No Change No Change No Change | O |
| 29 | 74 | Sodium Ligno-sulfonate 0.20% | Polyoxy-ethylene Nonylphenyl Ether (HLB 15.5) 0.40% | Sodium Salt of Isobutylene-Maleate Copolymer (MW: 150,000) 0.040% | 330 | 49 | Some Oil Droplets Good Emulsification No Sediment | No Change No Change No Change | Small Oil Film No Change No Change | No Change Slightly Creamy Soft Sediment | No Change No Change No Change | O |
| 30 | 74 | Sodium Ligno-sulfonate 0.20% | Polyoxy-ethylene Nonylphenyl Ether (HLB 15.5) 0.40% | Polyvinyl Alcohol (MW: 300,000) 0.040% | 350 | 50 | Some Oil Droplets Good Emulsification No Sediment | No Change No Change No Change | Small Oil Film No Change No Change | No Change Slightly Creamy Soft Sediment | No Change No Change No Change | O |
| 31 | 74 | Sodium Ligno-sulfonate 0.20% | Polyoxy-ethylene Nonylphenyl Ether (HLB 15.5) 0.40% | Polyvinyl Pyrrolidone (MW: 200,000) 0.040% | 340 | 46 | Some Oil Droplets Good Emulsification No Sediment | No Change No Change No Change | Small Oil Film No Change No Change | No Change Slightly Creamy Soft Sediment | No Change No Change No Change | O |
| 32 | 74 | Sodium Ligno-sulfonate 0.20% | Polyoxy-ethylene Nonylphenyl Ether (HLB 15.5) 0.40% | Poly-ethylene Oxide (MW: 500,000) 0.040% | 330 | 56 | Some Oil Droplets Good Emulsification No Sediment | No Change No Change No Change | No Change No Change No Change | Small Oil Film No Change Slight Soft Sediment | No Change Slightly Creamy Soft Sediment | O |
| 33 | 71 | Sodium Ligno-sulfonate 0% | Polyoxy-ethylene Nonylphenyl Ether (HLB | Oxidized Starch 0% | 600 | 23 | Small Oil Film Good Emulsification | No Change Creamy | Large Oil Film No Change | No Change No Change | No Change No Change | X |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | | 15.5) 0.60% | | | | No Sediment | Soft Sediment | Hard Sediment | No Change | No Change | |
| 34 | 71 | Sodium Ligno-sulfonate 0% | Polyoxy-ethylene Nonylphenyl Ether (HLB 15.5) 0.60% | Xanthan Gum 0.010% | 680 | 36 | Some Oil Droplets<br>Good Emulsification<br>No Sediment | Small Oil Film<br>No Change<br>No Change | No Change<br>Slightly Creamy<br>Soft Sediment | Large Oil Film<br>No Change<br>No Change | No Change<br>Creamy<br>Hard Sediment | Δ |
| 35 | 71 | Sodium Ligno-sulfonate 0% | Polyoxy-ethylene Nonylphenyl Ether (HLB 15.5) 0.60% | Xanthan Gum 0.040% | 720 | 48 | Some Oil Droplets<br>Good Emulsification<br>No Sediment | No Change<br>No Change<br>No Change | Small Oil Film<br>No Change<br>No Change | No Change<br>Slightly Creamy<br>Soft Sediment | No Change<br>No Change<br>No Change | O |
| 36 | 71 | Sodium Ligno-sulfonate 0% | Ethylene Oxide Addition Product of a Mixture of Beef Tallow and Glycerine (1:0.5) (HLB 15.5) 0.60% | Xanthan Gum 0% | 560 | 28 | Some Oil Droplets<br>Good Emulsification<br>No Sediment | No Change<br>Slightly Creamy<br>Soft Sediment | Large Oil Film<br>Creamy<br>Hard Sediment | No Change<br>No Change<br>No Change | No Change<br>No Change<br>No Change | X |
| 37 | 71 | Sodium Ligno-sulfonate 0% | Ethylene Oxide Addition Product of a Mixture of Beef Tallow and Glycerine (1:0.5) (HLB 15.5) 0.40% | Xanthan Gum 0.040% | 620 | 49 | Small Oil Film<br>Good Emulsification<br>No Sediment | No Change<br>No Change<br>No Change | No Change<br>No Change<br>No Change | Small Oil Film<br>Slighty Creamy<br>No Change | No Change<br>No Change<br>Soft Sediment | O |
| 38 | 71 | Sodium Ligno-sulfonate 0% | Ethylene Oxide Addition Product of a Mixture of Beef Tallow and | Xanthan Gum 0% | 530 | 31 | Small Oil Film<br>Good Emulsification<br>No Sediment | No Change<br>No Change<br>No Change | No Change<br>Slighty Creamy<br>Soft Sediment | Large Oil Film<br>Creamy<br>Hard Sediment | No Change<br>No Change<br>No Change | X |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | | Glycerine (1:0.5) (HLB 15.5) 1.00% | | | | | | | | | |
| 39 | 71 | Sodium Ligno-sulfonate 0% | Ethylene Oxide Addition Product of a Mixture of Beef Tallow and Glycerine (1:0.5) (HLB 15.5) 1.00% | Xanthan Gum 0.040% | 610 | 51 | Small Oil Droplets<br>Good Emulsification<br>No Sediment | No Change<br>No Change<br>No Change | No Change<br>No Change<br>No Change | No Change<br>Slighty Creamy<br>No Change | Large Oil Film<br>No Change<br>Soft Sediment | O |
| 40 | 71 | Sodium Ligno-sulfonate 0% | Polyoxy-ethylene Oleyl Ether (HLB 15.2) 0.60% | Xanthan Gum 0% | 600 | 23 | Small Oil Film<br>Good Emulsification<br>No Sediment | No Change<br>Creamy<br>Soft Sediment | Large Oil Film<br>No Change<br>Hard Sediment | No Change<br>No Change<br>No Change | No Change<br>No Change<br>No Change | X |
| 41 | 71 | Sodium Ligno-sulfonate 0% | Polyoxy-ethylene Oleyl Ether (HLB 15.2) 0.60% | Xanthan Gum 0.040% | 750 | 48 | Some Oil Droplets<br>Good Emulsification<br>No Sediment | No Change<br>No Change<br>No Change | Small Oil Film<br>No Change<br>No Change | No Change<br>Slightly Creamy<br>Soft Sediment | No Change<br>No Change<br>No Change | O |
| 42 | 71 | Sodium Ligno-sulfonate 0% | Polyoxy-ethylene Nonylphenyl Ether (HLB 15.5) 0.60% | Casein Ammonium Salt 0.040% | 770 | 32 | Some Oil Droplets<br>Good Emulsification<br>No Sediment | No Change<br>No Change<br>No Change | Small Oil Film<br>No Change<br>No Change | No Change<br>Slightly Creamy<br>Soft Sediment | Large Oil Film<br>Creamy<br>Some Hard Sediment | Δ |
| 43 | 71 | Sodium Ligno-sulfonate 0% | Polyoxy-ethylene Nonylphenyl Ether (HLB 15.5) 0.60% | Locust Bean Gum 0.040% | 780 | 30 | Some Oil Droplets<br>Good Emulsification<br>No Sediment | No Change<br>No Change<br>No Change | Small Oil Film<br>No Change<br>No Change | No Change<br>Slightly Creamy<br>Soft Sediment | Large Oil Film<br>Creamy<br>Some Hard Sediment | Δ |
| 44 | 71 | Sodium Ligno- | Polyoxy-ethylene | Sodium Arginate | 760 | 29 | Some Oil Droplets | No Change | Small Oil Film | No Change | Large Oil Film | Δ |

TABLE 3-continued

| Test No. | Asphalt Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 60° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | sulfonate 0% | Nonylphenyl Ether (HLB 15.5) 0.60% | Salt 0.040% | | | Good Emulsification | No Change | No Change | Slightly Creamy | Creamy | |
| | | | | | | | No Sediment | No Change | No Change | Soft Sediment | Some Hard Sediment | |
| 45 | 74 | Formalin Condensate of Sodium Naphthalene Sulfonate (Degree of Condensation: 4.1) 0.20% | Polyoxyethylene Nonylphenyl Ether (HLB 15.5) 0.40% | Xanthan Gum 0.040% | 245 | 69 | No Oil Droplets | No Change | No Change | No Change | No Change | ◎ |
| | | | | | | | Good Emulsification | No Change | No Change | No Change | Slightly Creamy | |
| | | | | | | | No Sediment | No Change | No Change | No Change | No Change | |

TABLE 4

| Test No. | Asabaska Bitumen Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 40° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| 1 | 73 | Sodium Ligno-sulfonate 0% | Polyoxy-ethylene Nonylphenyl Ether (HLB 15.5) 0% | Xanthan Gum 0% | Immeasurable | 0 | Test Discontinued | | | | | X |
| 2 | 73 | Sodium Ligno-sulfonate 0.2% | Polyoxy-ethylene Nonylphenyl Ether (HLB 15.5) 0.40% | Xanthan Gum 0.010% | 280 | 72 | No Oil Droplets Good Emulsification No Sediment | No Change No Change No Change | No Change No Change No Change | No Change Slightly Creamy No Change | No Change No Change Soft Sediment | O |
| 3 | 73 | Sodium Ligno-sulfonate 0.2% | Polyoxy-ethylene Nonylphenyl Ether (HLB 15.5) 0.40% | Xanthan Gum 0.040% | 210 | 74 | No Oil Droplets Good Emulsification No Sediment | No Change No Change No Change | No Change No Change No Change | No Change No Change No Change | No Change Slightly Creamy No Change | ◎ |
| 4 | 73 | Formalin Condensate of Sodium Naphthalene Sulfonate (Degree of Condensation: 4.1) 0.20% | Polyoxy-ethylene Nonylphenyl Ether (HLB 15.5) 0.40% | Xanthan Gum 0% | 210 | 46 | Some Oil Droplets Good Emulsification No Sediment | No Change No Change No Change | Small Oil Film Slightly Creamy Soft Sediment | No Change Creamy No Change | Large Oil Film No Change Hard Sediment | X |
| 5 | 73 | Formalin Condensate of Sodium Naphthalene Sulfonate (Degree of Condensation: 4.1) 0.20% | Polyoxy-ethylene Nonylphenyl Ether (HLB 15.5) 0.40% | Xanthan Gum 0.040% | 236 | 73 | No Oil Droplets Good Emulsification No Sediment | No Change No Change No Change | No Change No Change No Change | No Change No Change No Change | No Change Slightly Creamy No Change | ◎ |
| 6 | 74 | Formalin Condensate of Sodium Naphthalene Sulfonate (Degree of | Ethylene Oxide Addition Product of a Mixture of Beef | Xanthan Gum 0.040% | 227 | 77 | No Oil Droplets Good Emulsification No Sediment | No Change No Change No Change | No Change No Change No Change | No Change No Change No Change | No Change Slightly Creamy No Change | ◎ |

TABLE 4-continued

| Test No. | Asabaska Bitumen Concentration (%) | Surface Activating Agents, Polymer Substances and Amounts of Addition (%): Anionic Surface Activating Agent | Nonionic Surface Activating Agent | Polymer Substance | Physical Properties During Preparation: Viscosity (c.P. 40° C.) | Amount Passing Through Strainer (100 Mesh) (%) | Observation of Dispersion State After Standing: After 1 Day | After 7 Days | After 21 Days | After 1 Month | After 3 Months | Overall Evaluation |
|---|---|---|---|---|---|---|---|---|---|---|---|---|
| | | Condensation: 4.1) 0.20% | Tallow and Glycerine (1:0.5) (HLB 15.5) 0.40% | | | | | | | | | |
| 7 | 71 | Formalin Condensate of Sodium Naphthalene Sulfonate (Degree of Condensation: 4.1) 0% | Ethylene Oxide Addition Product of a Mixture of Beef Tallow and Glycerine (1:0.5) (HLB 15.5) 0.60% | Xanthan Gum 0% | 500 | 35 | Small Oil Film Good Emulsification No Sediment | No Change Creamy Soft Sediment | Large Oil Film No Change Hard sediment | No Change No Change No Change | No Change No Change No Change | X |
| 8 | 71 | Formalin Condensate of Sodium Naphthalene Sulfonate (Degree of Condensation: 4.1) 0% | Ethylene Oxide Addition Product of a Mixture of Beef Tallow and Glycerine (1:0.5) (HLB 15.5) 0.60% | Xanthan Gum 0.040% | 680 | 54 | Some Oil Droplets Good Emulsification No Sediment | No Change No Change No Change | Small Oil Film No Change No Change | No Change Slightly Creamy Soft Sediment | No Change No Change No Change | O |
| 9 | 71 | Formalin Condensate of Sodium Naphthalene Sulfonate (Degree of Condensation: 4.1) 0% | Polyoxyethylene Nonylphenyl Ether (HLB 15.5) 0.60% | Xanthan Gum 0% | 540 | 30 | Small Oil Film Good Emulsification No Sediment | No Change Creamy Soft Sediment | Large Oil Film No Change Hard Sediment | No Change No Change No Change | No Change No Change No Change | X |
| 10 | 71 | Formalin Condensate of Sodium Naphthalene Sulfonate (Degree of Condensation: 4.1) 0% | Polyoxyethylene Nonylphenyl Ether (HLB 15.5) 0.60% | Xanthan Gum 0.040% | 580 | 53 | Small Oil Film Good Emulsification No Sediment | No Change No Change No Change | No Change No Change No Change | No Change Slightly Creamy No Change | No Change No Change Soft Sediment | O |

We claim:

1. A super-heavy oil emulsion fuel consisting essentially of 100 parts by weight of super-heavy oil, 30–80 parts by weight of water, 0.01–4 parts by weight of at least one anionic surface active agent selected from groups (i)–(vii) enumerated below, and at least one nonionic surface active agent having an HLB (hydrophilic-lipophilic balance) of 9–19 and selected from groups (I)–(VII) enumerated below, wherein the weight ratio of said anionic surface active agent/nonionic surface active agent is from 1/99–75/25;

anionic surface active agents:

(i) the group consisting of formaldehyde condensation products of sulfonic acid or sulfonate salts of cyclic aromatic compounds in which the average degree of condensation of formaldehyde is 1.2–100, wherein the salts are lower amine salts, alkali metal salts or alkaline earth metal salts, (ii) the group consisting of formaldehyde condensation products of lignosulfonic acid, lignosulfonate salts, derivatives thereof and lignosulfonate and sulfonates of aromatic compounds, and salts thereof, wherein said salts are lower amine salts, alkali metal salts or alkaline earth metal salts, and wherein the average degree of condensation of formaldehyde is 1.2–50, (iii) the group consisting of copolymers and salts thereof of polystyrene sulfonic acid, salts thereof, or styrene sulfonic acid with other copolymerizable monomers, said copolymers having a molecular weight of 500–500,000, wherein said salts are lower amine salts, alkali metal salts or alkaline earth metal salts, (iv) the group consisting of dicyclopentadiene sulfonate polymers and salts thereof in which the molecular weight of the polymer is 500–500,000 and wherein said salts are lower amine salts, alkali metal salts or alkaline earth metal salts, (v) the group consisting of copolymers of maleic anhydride and/or itaconic anhydride, their acids and their salts with other copolymerizable monomers in which the molecular weight of the copolymer is 500–500,000, wherein said salts are ammonium salts or alkali metal salts, (vi) the group consisting of the maleic compounds and their salts of liquid polybutadiene in which the molecular weight of liquid butadiene is 500–200,000, wherein said salts are ammonium salts, or alkali metal salts, (vii) the group consisting of the following anionic surface active agents having 1 to 2 hydrophilic groups in the same molecule, (a) sulfuric ester salts of alcohols having 4–18 carbon atoms wherein said salts are lower amine salts, alkali metal salts or alkaline earth metal salts, (b) alkanes, alkenes and/or alkylaryl sulfonates or their salts having 4–18 carbon atoms in which said salts are lower amine salts, alkali metal salts or alkaline earth metal salts, (c) sulfates or phosphate esters and salts of the alkylene oxide addition products of compounds having 1 or more active hydrogens in the same molecule, (d) sulfosuccinate salts which are esters of saturated or unsaturated fatty acids having 4–22 carbon atoms, (e) alkyldiphenylether disulfonates and their salts in which the alkyl groups have 8–18 carbon atoms, (f) rosin acids and their salts, tall oil and mixtures of rosin acid and higher fatty acids and salts thereof, in which the salts are ammonium, sodium or potassium salts, (g) alkane or alkene fatty acids having 4–18 carbon atoms and their salts in which the salts are ammonium, potassium or sodium;

nonionic surface active agents:

(I) the group consisting of alkylene oxide addition products of compounds having phenolic hydroxyl groups, in which the alkylene oxide is ethylene oxide and/or propylene oxide, butylene oxide or styrene oxide, (II) the group consisting of the alkylene oxide addition products of formaldehyde condensation products of compounds having phenolic hydroxyl groups, in which a condensation degree is 1.2–100 and the alkylene oxide is ethylene oxide and/or propylene oxide, butylene oxide or styrene oxide, (III) the group consisting of the alkylene oxide addition products of monovalent aliphatic alcohols and/or aliphatic amines having 2–50 carbon atoms, in which the alkylene oxide is ethylene oxide and/or propylene oxide, butylene oxide or styrene oxide, (IV) the group consisting of the block or random addition polymers of ethylene oxide and propylene oxide and/or butylene oxide and styrene oxide, (V) the group consisting of the alkylene oxide addition products of polyhydric alcohols, or esters of said polyhydric alcohols and fatty acids having 8–18 carbon atoms, wherein the alkylene oxide is ethylene oxide and/or propylene oxide, butylene oxide or styrene oxide, (VI) alkylene oxide addition products of amines having a multiple number of active hydrogen atoms, wherein the alkylene oxide is ethylene oxide and/or propylene oxide, butylene oxide or styrene oxide, (VII) products of the reaction resulting from the addition of an alkylene oxide to a mixture of 1 mole of triglyceride oil and 1 or 2 or more polyhydric alcohols selected from the group consisting of glycerine, trimethylolpropane, pentaerythritol, sorbitol, sucrose, ethylene glycol, polyethylene glycol having a molecular weight of 1000 or less, propylene glycol, and polypropylene glycol having a molecular weight of 1000 or less, and/or 0.1–5 moles of water, wherein the alkylene oxide is ethylene oxide and/or propylene oxide, butylene oxide or styrene oxide.

2. A super-heavy oil emulsion fuel as described in claim 1, wherein said at least one anionic surface active agent is selected from the group consisting of formaldehyde condensation products of lignosulfonic acid, lignosulfonate salts, derivatives thereof and lignosulfonates and sulfonates of aromatic compounds, and salts thereof, said salts being lower amine salts, alkali metal salts or alkaline earth metal salts and the average degree of condensation of formaldehyde is 1.2–50, and said at least one nonionic surface active agent is selected from among the products of the reaction resulting from the addition of an alkylene oxide to a mixture of 1 mole of triglyceride oil and 1 or 2 or more polyhydric alcohols selected from the group consisting of glycerine, trimethylolpropane, pentaerythritol, sorbitol, sucrose, ethylene glycol, polyethylene glycol having a molecular weight of 1000 or less, and/or water, wherein the alkylene oxide is ethylene oxide and/or propylene oxide, butylene oxide or styrene oxide.

3. A super-heavy oil emulsion fuel as described in claim 1, wherein said anionic surface active agent is sodium ligninsulfonate, said nonionic surface active agent is polyoxyethylene nonphenyl ether having an HLB of about 15.5 and said super-heavy oil is selected from the group consisting of asphalt and bitumen.

4. A super-heavy oil emulsion fuel consisting essentially of 100 parts by weight of super-heavy oil, 30–80 parts by weight of water, 0.05–4 parts by weight of at least one nonionic surface active agent having an HLB (hydrophilic-lipophilic balance) of 9–19 and selected from groups (I)–(VII) enumerated below, and 0.003–1 weight of at least on hydrophilic polymer substance selected from groups (A)–(D) enumerated below, and/or 0.01–1 part by weight of at least one aqueous synthetic polymer selected from groups (a)–(f) enumerated below;

nonionic surface active agent:

(I) the group consisting of the alkylene oxide addition products of compounds having phenolic hydroxyl groups, in which the alkylene oxide is ethylene oxide and/or propylene oxide, butylene oxide or styrene oxide, (II) the group consisting of the alkylene oxide addition products of formaldehyde condensation products of compounds having phenolic hydroxyl groups, in which a condensation degree is 1.2–100 and the alkylene oxide is ethylene oxide and/or propylene oxide, butylene oxide or styrene oxide, (III) the group consisting of the alkylene oxide addition products of monovalent aliphatic alcohols and/or aliphatic amines having 2–50 carbon atoms, in which the alkylene oxide is ethylene oxide and/or propylene oxide, butylene oxide or styrene oxide, (IV) the group consisting of the block or random addition polymers of ethylene oxide and propylene oxide and/or butylene oxide and styrene oxide, (V) the group consisting of the alkylene oxide addition products of polyhydric alcohols, or esters of said polyhydric alcohols and fatty acids having 8–18 carbon atoms, wherein the alkylene oxide is ethylene oxide and/or propylene oxide, butylene oxide or styrene oxide, (VI) alkylene oxide addition products of amines having a multiple number of active hydrogen atoms, wherein the alkylene oxide is ethylene oxide and/or propylene oxide, butylene oxide or styrene oxide, (VII) products of the reaction resulting from the addition of an alkylene oxide to a mixture of 1 mole of triglyceride oil and 1 or 2 or more polyhydric alcohols selected from the group consisting of glycerine, trimethylolpropane, pentaerythritol, sorbitol, sucrose, ethylene glycol, polyethylene glycol having a molecular weight of 1000 or less, propylene glycol, and polypropylene glycol having a molecular weight of 1000 or less, and/or 0.1–5 moles of water, wherein the alkylene oxide is ethylene oxide and/or propylene oxide, butylene oxide or styrene oxide, hydrophilic polymer substance:

(A) microorganism-origin hydrophilic polymer substance selected from the group consisting of xanthan gum, bluran, dextran, (B) plant-origin hydrophilic polymer substance selected from the group consisting of agar, galaginan, phaseleran, arginate and its salts (Na, K, $NH_4$, Ca, Mg), locust bean pg,62 gum, gua gum, fatsia gum, tamarind gum, arabian gum, karaya gum, tragacanth gum, pectin, gelatin, casein, cellulose derivatives and processed starch, synthetic polymer:

(a) homopolymers of (meth)acrylic acid and its derivatives and copolymers thereof with other monomers,

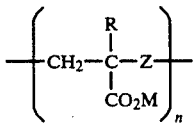

where

R is H, methyl or ethyl,

M is H, Na, K, Li or $NH_4$,

Z is

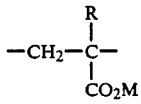

and monomers which can copolymerize with this monomer and its salts, and n is 50–100,000

(b) copolymers of acrylamide or derivatives thereof, and other copolymerizable monomers,

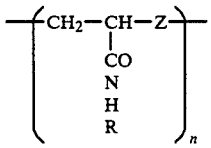

where

R is H or $CH_2CH_2OH$

Z is

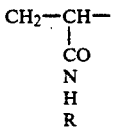

or monomers which can be polymerized with this monomer, and its salts ($NH_4$, Na, K, Li), and n is 50–100,000

(c) salts of copolymers of maleic anhydride or itaconic anhydride and other copolymerizable monomers,

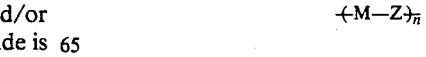

where

M is maleic anhydride or itaconic anhydride

Z is an α-olefin or styrene, and n is 50–100,000

(d) homopolymers and copolymers of vinyl alcohol,

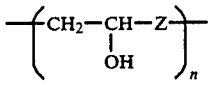

where

Z is vinyl acetate or styrene, and p2 n is 30–100,000

(e) homopolymers and copolymers of vinylpyrrolidone,

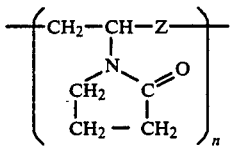

where

Z is a unit of a monomer which can copolymerize with vinylpyrrolidone and its salts, and n is 50–100,000

(f) polyethyleneoxide (PEO) with a molecular weight of 10,000–3,000,000.

5. A super-heavy oil emulsion fuel as described in claim 4, wherein said nonionic surface active agent is polyoxyethylene nonylphenyl ether and said hydrophilic polymer substance is Xanthan Gum.

6. A super-heavy oil emulsion fuel consisting essentially of 100 parts by weight of super-heavy oil, 30–80 parts by weight of water, 0.05–4 parts by weight of at least one nonionic surface active agent having an HLB (hydrophilic-lipophilic balance) of 9–19 and selected from groups (I)–(VII) enumerated below, 0.005–4 parts by weight of at least anionic surface active agent selected from groups (i)–(vii) enumerated below, 0.003–1 part by weight of at least one hydrophilic polymer substance selected from groups (A)–(D) enumerated below, and/or 0.01–1 part by weight of at least one aqueous synthetic polymer selected from groups (a)–(f) enumerated below;

nonionic active agent:

(I) the group consisting of the alkylene oxide addition products of compounds having phenolic hydroxyl groups, in which the alkylene oxide is ethylene oxide and/or propylene oxide, butylene oxide or styrene oxide, (II) the group consisting of the alkylene oxide addition products of formaldehyde condensation products of compounds having phenolic hydroxyl groups, in which a condensation degree is 1.2–100 and the alkylene oxide is ethylene oxide and/or propylene oxide, butylene oxide or styrene oxide, (III) the group consisting of the alkylene oxide addition of monovalent aliphatic alcohols and/or aliphatic amines having 2–50 carbon atoms, in which the alkylene oxide is ethylene oxide an propylene oxide, butylene oxide or styrene oxide, (IV) the group consisting of the block or random addition polymers of ethylene oxide and propylene oxide and/or butylene oxide and styrene oxide, (V) the group consisting of the alkylene oxide addition products of polyhydric alcohols, or esters of said polyhydric alcohols and fatty acids having 8–18 carbon atoms, wherein the alkylene oxide is ethylene oxide and/or propylene oxide, butylene oxide or styrene oxide, (VI) alkylene oxide addition products of amines having a multiple number of active hydrogen atoms, wherein the alkylene oxide is ethylene oxide and/or propylene oxide, butylene oxide or styrene oxide, (VII) products of the reaction resulting from the addition of an alkylene oxide to a mixture of 1 mole of triglyceride oil and 1 or 2 or more polyhydric alcohols selected from the group consisting of glycerine, trimethylolpropane, pentaerythritol, sorbitol, sucrose, ethylene glycol, polyethylene glycol having a molecular weight of 1000 or less, propylene glycol, and polypropylene glycol having a molecular weight of 1000 or less, and/or 0.1–5 moles of water, wherein the alkylene oxide is ethylene oxide and/or propylene oxide, butylene oxide or styrene oxide, hydrophilic polymer substance:

(A) microorganism-origin hydrophilic polymer substance selected from the group consisting of xanthan gum, bluran, dextran, (B) plant-origin hydrophilic polymer substance selected from the group consisting of agar, galaginan, phaseleran, arginate and its salts (Na, K, $NH_4$, Ca, Mg), locust bean gum, gua gum, fatsia gum, tamarind gum, arabian gum, karaya gum, tragacanth gum, pectin, gelatin, casein, cellulose derivatives and processed starch, synthetic polymer:

(a) homopolymers of (meth)acrylic acid and its derivatives and copolymers thereof with other monomers,

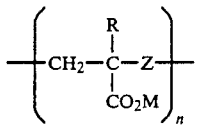

where

R is H, methyl or ethyl,

M is H, Na, K, Li or $NH_4$

Z is

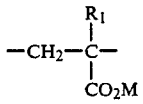

and monomers which can copolymerize with this monomer and its salts, and n is 50–100,000

(b) copolymers of acrylamide or derivatives thereof, and other copolymerizable monomers,

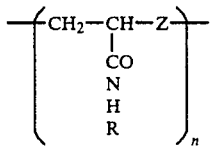

where

R is H or $CH_2CH_2OH$

Z is

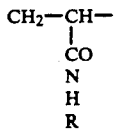

or monomers which can be polymerized with monomer, and its salts ($NH_4$, Na, K, Li), and n is 50–100,000

(c) salts of copolymers of maleic anhydride or itaconic anhydride and other copolymerizable monomers,

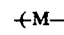

where

M is maleic anhydride or itaconic anhydride

Z is an α-olefin or styrene, and n is 50–100,000

(d) homopolymers and copolymers of vinyl alcohol,

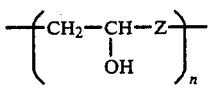

where

Z is vinyl acetate or styrene, and n is 30–100,000

(e) homopolymers and copolymers of vinylpyrrolidone,

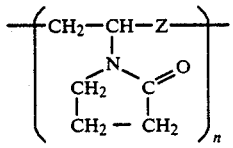

where

Z is a unit of a monomer which can copolymerize with vinylpyrrolidone and its salts, and n is 50–100,000

(f) polyethyleneoxide (PEO) with a molecular weight of 10,000–3,000,000, anionic surface active agent:

(i) the group consisting of formaldehyde condensation products of sulfonic acid or sulfonate salts of cyclic aromatic compounds in which the average degree of condensation of formaldehyde is 1.2–100, wherein the salts are lower amine salts, alkali metal salts or alkaline earth metal salts, (ii) the group consisting of formaldehyde condensation products of lignosulfonic acid, lignosulfonate salts, derivatives thereof and lignosulfonates and sulfonates of aromatic compounds, and salts thereof, wherein said salts are lower amine salts, alkali metal salts or alkaline earth metal salts and wherein the average degree of condensation of formaldehyde is 1.2–50, (iii) the group consisting of copolymers and salts thereof of polystyrene sulfonic acid, salts thereof, or styrene sulfonic acid with other copolymerizable monomers, said copolymers having a molecular weight of 500–500,000, wherein said salts are lower amine salts, alkali metal or alkaline earth metal salts, (iv) the group consisting of dicyclopentadiene sulfonate polymers and salts thereof in which the molecular weight of the polymer is 500–500,000 and wherein said salts are lower amine salts, alkali metal salts or alkaline earth metal salts, (v) the group consisting of copolymers of maleic anhydride and/or itaconic anhydride, their acids and their salts with other copolymerizable monomers in which the molecular weight is 500–500,000, wherein said salts are ammonium salts or alkali metal salts, (vi) the group consisting of the maleic compounds and their salts of liquid polybutadiene in which the molecular weight of liquid butadiene is 500–200,000, wherein said salts are ammonium salts, or alkali metal salts, (vii) the group consisting of the following anionic surface active agents having 1 or 2 hydrophilic groups in the same molecule, (a) sulfuric ester salts of alcohols having 4–18 carbon atoms wherein said salts are lower amine salts, alkali metal salts or alkaline earth metal salts, (b) alkanes, alkenes and/or alkylaryl sulfonates or their salts having 4–18 carbon atoms in which said salts are lower amine salts, alkali metal salts or alkaline earth metal salts, (c) sulfates or phosphate esters and salts of the alkylene oxide addition products of compounds having 1 or more active hydrogens in the same molecule, (d) sulfosuccinate salts which are esters of saturated or unsaturated fatty acids having 4–22 carbon atoms, (e) alkyldiphenylether disulfonates and their salts in which the alkyl groups have 8–18 carbon atoms, (f) rosin acids and their salts, tall oil and mixtures of rosin acid and higher fatty acids and salts thereof, in which the salts are ammonium, sodium or potassium salts, (g) alkane or alkene fatty acids having 4–18 carbon atoms and their salts in which the salts are ammonium, potassium or sodium.

7. A super-heavy oil emulsion fuel as described in claim 6, wherein said anionic surface active agent is sodium lignosulfonate, said nonionic surface active agent is polyoxyethylene nonylphenyl ether having an HLB of about 15.5 and said hydrophilic polymer substance is Xanthan Gum.

8. A super-heavy oil emulsion fuel as described in claim 4 or claim 6 in which the hydrophilic polymer substance is xanthan gum and the amount of xanthan gum added is 0.01–0.1 parts to 100 parts by weight of the super-heavy oil.

9. A super-heavy oil emulsion fuel as described in claim 1, claim 4 or claim 6 in which the HLB of the nonionic surface activating agent is from 12–17.

10. A super-heavy oil emulsion fuel as described in claim 1, claim 4 or claim 6 in which the super-heavy oil has a softening point of 50° C. or lower.

11. A super-heavy oil emulsion fuel as described in claim 1, or claim 6 in which the weight ratio of anionic surface activating agent to nonionic surface activating agent is from 10:90–40:60.

12. A super-heavy oil emulsion fuel as described in claim 1, claim 4 or claim 6 in which the nonionic surface activating agent is (VII).

13. A super-heavy oil emulsion fuel as described in claim 1 or claim 6 in which the anionic surface activating agent is (I) and/or (II).

14. A super-heavy oil emulsion fuel as described in claim 1 or claim 6 in which the anionic surface activating agent is (I) and/or (II), and the nonionic surface activating agent is (VII).

15. A super-heavy oil emulsion fuel as described in claim 4 or claim 6 in which the nonionic surface activating agent is (VII) or (II) or (III), and the hydrophilic polymer substance is xanthan gum.

16. A super-heavy oil emulsion fuel as described in claim 1, claim 4 or claim 6 in which the amount of water added is 33–50 parts with respect to 100 parts of the super-heavy oil.

* * * * *

UNITED STATES PATENT AND TRADEMARK OFFICE

CERTIFICATE OF CORRECTION

PATENT NO. : 5 024 676

DATED : June 18, 1991

INVENTOR(S) : Noboru MORIYAMA et al

It is certified that error appears in the above-identified patent and that said Letters Patent is hereby corrected as shown below:

Column 43, line 52; change "1 to 2" to ---1 or 2---.

Column 45, line 16; after "0.003-1" insert ---part by---.

line 17; change "on" to ---one---.

Column 46, line 7; delete "pg,62".

Column 47, line 10; delete "p2".

line 38; after "least" insert ---one---.

line 45; after "nonionic" insert ---surface---.

line 58; after "tion" insert ---products---.

line 60; change "an" to ---and/or---.

Signed and Sealed this

Third Day of November, 1992

*Attest:*

*Attesting Officer*

DOUGLAS B. COMER

*Acting Commissioner of Patents and Trademarks*